US007597087B2

(12) United States Patent
Nakano et al.

(10) Patent No.: US 7,597,087 B2
(45) Date of Patent: Oct. 6, 2009

(54) CONTROLLER OF INTERNAL COMBUSTION ENGINE

(75) Inventors: Tomoaki Nakano, Toyota (JP); Hideki Suzuki, Chita-gun (JP)

(73) Assignee: Denso Corporation, Kariya (JP)

( * ) Notice: Subject to any disclaimer, the term of this patent is extended or adjusted under 35 U.S.C. 154(b) by 136 days.

(21) Appl. No.: 11/907,448

(22) Filed: Oct. 12, 2007

(65) Prior Publication Data

US 2008/0097681 A1 Apr. 24, 2008

(30) Foreign Application Priority Data

Oct. 20, 2006 (JP) ..... 2006-286114
Oct. 20, 2006 (JP) ..... 2006-286115

(51) Int. Cl.
*F02M 1/00* (2006.01)
*F02D 41/00* (2006.01)

(52) U.S. Cl. ..... 123/434; 123/435; 123/677

(58) Field of Classification Search ..... 123/434, 123/435, 352, 677, 679, 479, 488
See application file for complete search history.

(56) References Cited

U.S. PATENT DOCUMENTS 4,879,983 A * 11/1989 Shimomura et al. .... 123/339.23
5,007,399 A * 4/1991 Nakaniwa ..... 123/488
5,070,837 A * 12/1991 Nishimura et al. ..... 123/339.19
5,126,943 A * 6/1992 Nakaniwa ..... 701/106

FOREIGN PATENT DOCUMENTS

JP 04-043847 2/1992
JP 05-288101 11/1993
JP 09-170474 6/1997

* cited by examiner

*Primary Examiner*—John T Kwon
(74) *Attorney, Agent, or Firm*—Nixon & Vanderhye, PC

(57) ABSTRACT

An engine controller performs low opening degree control during a first intake stroke period since an engine start is commenced until first intake strokes of respective cylinders end. Thus, an opening degree of an intake throttle valve is controlled to a fully closed position or proximity of the fully closed position such that intake pressure downstream of the intake throttle valve becomes equal to or lower than critical pressure with respect to intake pressure upstream of the intake throttle valve during an intake stroke of each cylinder. The controller calculates a leak air quantity at the time when the intake throttle valve is fully closed based on an intake air quantity sensed during the low opening degree control. The controller corrects a feedback gain of idle speed control in accordance with the leak air quantity of the intake throttle valve.

2 Claims, 11 Drawing Sheets

| Qafm \ Thr | 0 | 2 | 4 | 6 | 8 | 10 |
|---|---|---|---|---|---|---|
| 0 | SMALL | | | | | |
| 2 | ↕ | | | | | |
| 4 | Qleakbse | | | | | |
| 6 | ↕ | | | | | |
| 8 | LARGE | ← | Qleakbse | | → | SMALL |

CONTROLLER OF INTERNAL COMBUSTION ENGINE

CROSS REFERENCE TO RELATED APPLICATION

This application is based on and incorporates herein by reference Japanese Patent Applications No. 2006-286114 filed on Oct. 20, 2006 and No. 2006-286115 filed on Oct. 20, 2006.

BACKGROUND OF THE INVENTION

1. Field of the Invention

The present invention relates to a controller of an internal combustion engine having intake throttle valves in intake passages of respective cylinders of the engine for adjusting intake air quantities.

2. Description of the Related Art

There has been a system having a throttle valve in an intake pipe upstream of intake manifolds of respective cylinders (i.e., in intake pipe collection part upstream of position where intake pipe branches into intake manifolds of cylinders) of an internal combustion engine for adjusting an intake air quantity and a bypass air quantity regulating valve (i.e., idle speed control valve) for adjusting a bypass air quantity flowing through a bypass passage bypassing the throttle valve to control idle speed. In such the system, there is a possibility that a leak air quantity of the throttle valve (air quantity passing through small gap between throttle valve and inner wall surface of intake passage when throttle valve is fully closed) varies due to manufacture tolerance, an aging change or the like and the controllability of the idle speed control decreases.

As a countermeasure, a device described in patent document 1 (JP-A-H5-288101) performs fuel cut control when the throttle valve is fully closed and rotation speed of the engine is equal to or higher than a predetermined value and calculates the leak air quantity of the throttle valve based on an intake air quantity sensed with an airflow meter while the bypass air quantity regulating valve is fully closed during the fuel cut control (i.e., while throttle valve is fully closed). The device controls the bypass air quantity regulating valve with the use of the leak air quantity during the idle operation.

When a device described in patent document 2 (JP-A-H9-170474) performs feedback control of the bypass air quantity regulating valve to conform actual rotation speed to target idle speed during the idle operation of the engine, the device estimates an external load of the engine and subtracts a control amount corresponding to the external load from a feedback correction amount. Thus, the device obtains and learns a value corresponding to a change of the leak air quantity of the throttle valve and corrects the feedback correction amount by using the learning value.

The applicants of the present application are currently studying a system having intake throttle valves in intake manifolds of respective cylinders of an internal combustion engine for adjusting intake air quantities. In such the system, as shown in FIG. 3, specifically in an area of a low opening degree Thr of the intake throttle valve (for example, in idle operation area), the quantity Gath of the passing air of the intake throttle valve increases and the intake air quantity increases as the leak air quantity Qleak of the intake throttle valve (air quantity passing through gap between intake throttle valve and inner wall surface of intake passage when intake throttle valve is fully closed) increases even when the opening degree Thr of the intake throttle valve is the same.

Accordingly, there is a possibility that the rotation of the engine rises during the idle operation.

If the leak air quantity Qleak of the intake throttle valve decreases, the passing air quantity Gath of the intake throttle valve decreases and the intake air quantity decreases even when the opening degree Thr of the intake throttle valve is the same. Therefore, there is a possibility that the rotation of the engine falls.

Moreover, if the leak air quantity Qleak of the intake throttle valve changes, the relationship between the opening degree Thr of the intake throttle valve and the passing air quantity Gath (i.e., change characteristic of passing air quantity Gath with respect to opening degree Thr of intake throttle valve) changes. Therefore, there occurs a problem that the control accuracy of the intake air quantity by the opening degree control of the intake throttle valve lowers.

A following problem will occur if the leak air quantity of the intake throttle valve is calculated based on the intake air quantity sensed with the airflow meter while the intake throttle valve is fully closed during the fuel cut control by using the technology of the patent document 1 in the system having the intake throttle valves in the intake manifolds of the respective cylinders of the engine. That is, the capacity of the intake passage downstream of the intake throttle valve is small in the system having the intake throttle valves in the intake manifolds of the respective cylinders of the engine. Therefore, if the intake throttle valve is fully closed during the fuel cut control (i.e., when rotation speed of engine is equal to or higher than fuel cut resuming rotation speed), intake air pressure downstream of the intake throttle valve declines greatly. As a result, there is a possibility that oil loss via valve guides (i.e., phenomenon that oil lubricating sliding parts of intake valve or the like leaks toward intake port and is suctioned into intake port) occurs and the combustion state and the emission of the engine worsen.

When the feedback control of the intake throttle valve is performed to conform the actual rotation speed to the target idle speed during the idle operation of the engine with the use of the technology of the patent document 2 in the system having the intake throttle valves in the intake manifolds of the respective cylinders of the engine, a method of calculating a value corresponding to the leak air quantity of the intake throttle valve by estimating the external load of the engine and by removing the control amount corresponding to the external load from the feedback correction amount could be employed. However, it is difficult to estimate the external load of the engine with high accuracy. Therefore, the method of calculating the leak air quantity of the intake throttle valve based on the feedback correction amount and the external load has a defect that the leak air quantity of the intake throttle valve cannot be calculated with high accuracy due to an estimation error of the external load.

A system described in patent document 3 (Japanese Patent Gazette No. 2536242) has shutoff valves (i.e., throttle valves) in intake passages of respective cylinders of an internal combustion engine for adjusting intake air quantities respectively and bypass passages bypassing the shutoff valves. The system has control valves (i.e., idle speed control valves) in the bypass passages of the respective cylinders for opening/closing the bypass passages respectively. During the idle operation period, the system fully closes the shutoff valves provided in the intake passages of the respective cylinders and controls valve opening periods of the control valves provided in the bypass passages of the cylinders. Thus, the system adjusts the intake air quantities and the idle speed.

In such the system, even if the valve opening periods of the control valves provided in the bypass passages of the respective cylinders are equalized during the idle operation, a variation is caused among the intake air quantities of the cylinders if the leak air quantities of the shutoff valves provided in the intake passages of the cylinders (air quantities passing through small gaps between shutoff valves and intake passage inner walls when shutoff valves are fully closed) vary among the cylinders due to manufacture tolerances, aging changes, and the like. Therefore, there is a possibility that torque of the respective cylinders varies and the idle speed fluctuate largely.

As a countermeasure, a technology described in the patent document 3 senses the rotation speed as of expansion strokes of the respective cylinders during the idle operation and calculates average rotation speed of all the cylinders. The technology corrects the valve opening period of each control valve provided in each bypass passage of each cylinder in accordance with a difference between the rotation speed of the cylinder and the average rotation speed of all the cylinders.

This technology corrects the valve opening period of each control valve provided in the bypass passage of each cylinder during the idle operation, in which the shutoff valve provided in the intake passage of each cylinder is fully closed. Thus, the technology corrects the variation among the intake air quantities of the cylinders due to the variation among the leak air quantities of the shutoff valves of the respective cylinders or the like during the idle operation. Therefore, in the operation range, in which the shutoff valves provided in the intake passages of the cylinders are opened, the variation among the intake air quantities of the cylinders due to the variation among the leak air quantities of the shutoff valves of the cylinders cannot be corrected. Accordingly, the rotation fluctuation of the engine due to the variation among the leak air quantities of the shutoff valves of the cylinders cannot be inhibited.

Moreover, when the technology of the patent document 3 is applied, installation of the bypass passages to the intake passages of the respective cylinders and installation of the control valves in the bypass passages of the respective cylinders are necessary. Therefore, the system structure will be complicated and the cost will be increased.

SUMMARY OF THE INVENTION

It is an object of the present invention to provide a controller of an internal combustion engine with a system having intake throttle valves in intake passages of respective cylinders of the engine capable of calculating leak air quantities of the intake throttle valves of the respective cylinders with high accuracy and of improving controllability of the intake air quantities without posing adverse effects to operation of the engine.

It is another object of the present invention to provide a controller of an internal combustion engine with a system having intake throttle valves in intake passages of respective cylinders of the engine capable of correcting a variation among intake air quantities due to a variation among leak air quantities of the intake throttle valves of the respective cylinders with high accuracy, suppressing rotation fluctuation of the engine due to the variation among the leak air quantities of the intake throttle valves of the respective cylinders and satisfying request for cost reduction.

According to an aspect of the present invention, a controller of an internal combustion engine having branch intake passages, which branch from a main intake passage of the engine and introduce intake air into respective cylinders, and intake throttle valves in the branch intake passages of the respective cylinders for adjusting the intake quantities has an intake air quantity sensor provided in the main intake passage for sensing the intake air quantity. The controller has a low opening degree control device that performs low opening degree control for controlling an opening degree of the intake throttle valve during a first intake stroke period since an engine start is commenced until first intake strokes of the respective cylinders are completed such that intake pressure downstream of the intake throttle valve becomes pressure equal to or lower than predetermined critical pressure with respect to intake pressure upstream of the intake throttle valve during an intake stroke of each cylinder. The controller has a leak air quantity calculation device that calculates a leak air quantity at the time when the intake throttle valve is fully closed based on the intake air quantity sensed with the intake air quantity sensor during the low opening degree control. The controller has an intake throttle valve opening degree correction device that corrects the opening degree of the intake throttle valve in accordance with the leak air quantity.

With this structure, the low opening degree control for controlling the opening degree of the intake throttle valve to the fully closed position or proximity of the fully closed position is performed so that the intake pressure downstream of the intake throttle valve becomes pressure (pressure at which passing air quantity changes in accordance with opening degree of intake throttle valve without being affected by pressure difference between pressure upstream of intake throttle valve and pressure downstream of intake throttle valve) equal to or lower than the predetermined critical pressure with respect to the intake pressure upstream of the intake throttle valve. By sensing the intake air quantity during the low opening degree control, the passing air quantity corresponding to the opening degree of the intake throttle valve during the low opening degree control can be sensed. During the low opening degree control, the passing air quantity changes in accordance with the opening degree of the intake throttle valve without being affected by the pressure difference between the pressure upstream of the intake throttle valve and the pressure downstream of the intake throttle valve. Therefore, by using a map or the like beforehand storing the relationship between the opening degree of the intake throttle valve and the passing air quantity during the low opening degree control in the form of data, the leak air quantity as the passing air quantity at the time when the intake throttle valve is fully closed can be calculated with high accuracy from the intake air quantity sensed with the intake air quantity sensor during the low opening degree control, i.e., the passing air quantity corresponding to the opening degree of the intake throttle valve under the low opening degree control.

The air is stored in the intake passage downstream of the intake throttle valve before the first intake strokes of the cylinders are completed after the engine start is commenced. Therefore, even if the low opening degree control for controlling the opening degree of the intake throttle valve to the fully closed position or the proximity of the fully closed position is performed during the first intake stroke period of the cylinders since the engine start is commenced until the first intake strokes of the respective cylinders are completed, the air necessary for the combustion in the engine start can be taken into the cylinders. As a result, adverse effect on the starting performance of the engine can be inhibited.

The change of the relationship between the opening degree of the intake throttle valve and the passing air quantity due to the change of the leak air quantity of the intake throttle valve (change characteristic of passing air quantity with respect to opening degree of intake throttle valve) can be compensated by correcting the opening degree of the intake throttle valve in accordance with the calculated leak air quantity of the intake throttle valve. Accordingly, the controllability of the intake air quantity through the opening degree control of the intake throttle valve can be improved without being affected by the aging change of the leak air quantity of the intake throttle valve and the like.

Furthermore, the leak air quantity of the intake throttle valve can be calculated when the engine is started. Therefore, the opening degree of the intake throttle valve can be corrected in accordance with the leak air quantity of the intake throttle valve even immediately after the engine start. Thus, the controllability of the intake air quantity can be improved even immediately after the engine start.

According to another aspect of the present invention, the controller performs low opening degree control for controlling the opening degree of the intake throttle valve during fuel cut control for stopping fuel injection of the engine so that the intake pressure downstream of the intake throttle valve becomes pressure that is equal to or lower than the predetermined critical pressure with respect to the intake pressure upstream of the intake throttle valve and that does not cause oil loss via valve guides in the intake stroke of each cylinder. The controller calculates a leak air quantity at the time when the intake throttle valve is fully closed based on the intake air quantity sensed with the intake air quantity sensor during the low opening degree control and corrects the opening degree of the intake throttle valve in accordance with the leak air quantity.

In the system having the intake throttle valves in the intake passages of the respective cylinders of the engine, the capacity of the intake passage downstream of the intake throttle valve is small. Therefore, if the intake throttle valve is fully closed during the fuel cut control (i.e., when rotation speed of engine is equal to or higher than fuel cut resuming rotation speed), there is a possibility that the intake pressure downstream of the intake throttle valve declines greatly and the oil loss via the valve guides occurs. The above-described controller performs the low opening degree control for controlling the opening degree of the intake throttle valve to the fully closed position or proximity of the fully closed position so that the intake pressure downstream of the intake throttle valve becomes the pressure that is equal to or lower than the critical pressure with respect to the intake pressure upstream of the intake throttle valve and that does not cause the oil loss via the valve guides during the fuel cut control. The controller calculates the leak air quantity at the time when the intake throttle valve is fully closed based on the intake air quantity sensed with the intake air quantity sensor during the low opening degree control. Thus, the leak air quantity of the intake throttle valve can be calculated with high accuracy while inhibiting the oil loss via the valve guides and eventual deterioration of the combustion state or emission of the engine.

According to yet another aspect of the present invention, a controller of an internal combustion engine having intake throttle valves in intake passages of respective cylinders of the engine for regulating intake air quantities, each intake throttle valve having a function to generate an airflow for equalizing a fuel-air mixture, has an exhaust gas recirculation adjustment device that adjusts an exhaust gas recirculation quantity of the engine, an exhaust gas recirculation increase control device that performs exhaust gas recirculation increase control for controlling the exhaust gas recirculation adjustment device such that the quantity of the exhaust gas recirculation increases during low load operation of the engine, an each cylinder leak air quantity information sensing device that senses a combustion state in each cylinder during the exhaust gas recirculation increase control as information about the leak air quantity at the time when the intake throttle valve of each cylinder is fully closed, a large leak air cylinder determination device that determines a cylinder (large leak air cylinder) causing a large leak air quantity of the intake throttle valve based on the sensed combustion state in each cylinder, and an each cylinder intake throttle valve opening degree correction device that corrects the opening degree of the intake throttle valve during a period corresponding to an intake stroke of the large leak air cylinder in accordance with the combustion state in the large leak air cylinder.

If the leak air quantity of the intake throttle valve increases when the intake throttle valve has the function to generate the airflow (e.g., tumble flow or swirl flow) for equalizing the fuel-air mixture, intensity of the airflow generated by the intake throttle valve is weakened correspondingly and the effect to equalize the fuel-air mixture is lowered. Therefore, if the exhaust gas recirculation quantity (EGR quantity) is increased during the low load operation of the engine, in which the influence of the EGR is large, the equalizing effect of the fuel-air mixture is further lowered by the influence of the EGR and the combustion state becomes unstable in the cylinder corresponding to the intake throttle valve with the large leak air quantity.

Paying attention to such the characteristic, the EGR increase control for controlling the EGR adjustment device to increase the EGR quantity during the low load operation of the engine is performed. The combustion states of the respective cylinders are sensed as information about the leak air quantities of the intake throttle valves of the respective cylinders during the EGR increase control, and the cylinder causing the unstable combustion state is determined based on the combustion states of the respective cylinders. Thus, the large leak air cylinder (cylinder with large leak air quantity) can be determined with high accuracy. The controller corrects the opening degree of the intake throttle valve during the period corresponding to the intake stroke of the large leak air cylinder in accordance with the combustion state (information about leak air quantity) in the large leak air cylinder. Thus, the opening degree of the intake throttle valve can be corrected in accordance with the leak air quantity of the intake throttle valve of the large leak air cylinder. By repeatedly performing the processing, the variation among the intake air quantities due to the variation among the leak air quantities of the intake throttle valves of the respective cylinders can be corrected with high accuracy, and the rotation fluctuation of the engine due to the variation among the leak air quantities of the intake throttle valves of the respective cylinders can be suppressed.

Moreover, there is no need to provide bypass passages bypassing the intake throttle valves of the respective cylinders or control valves for opening/closing the bypass passages of the respective cylinders. Therefore, the system structure can be simplified and the cost can be reduced.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
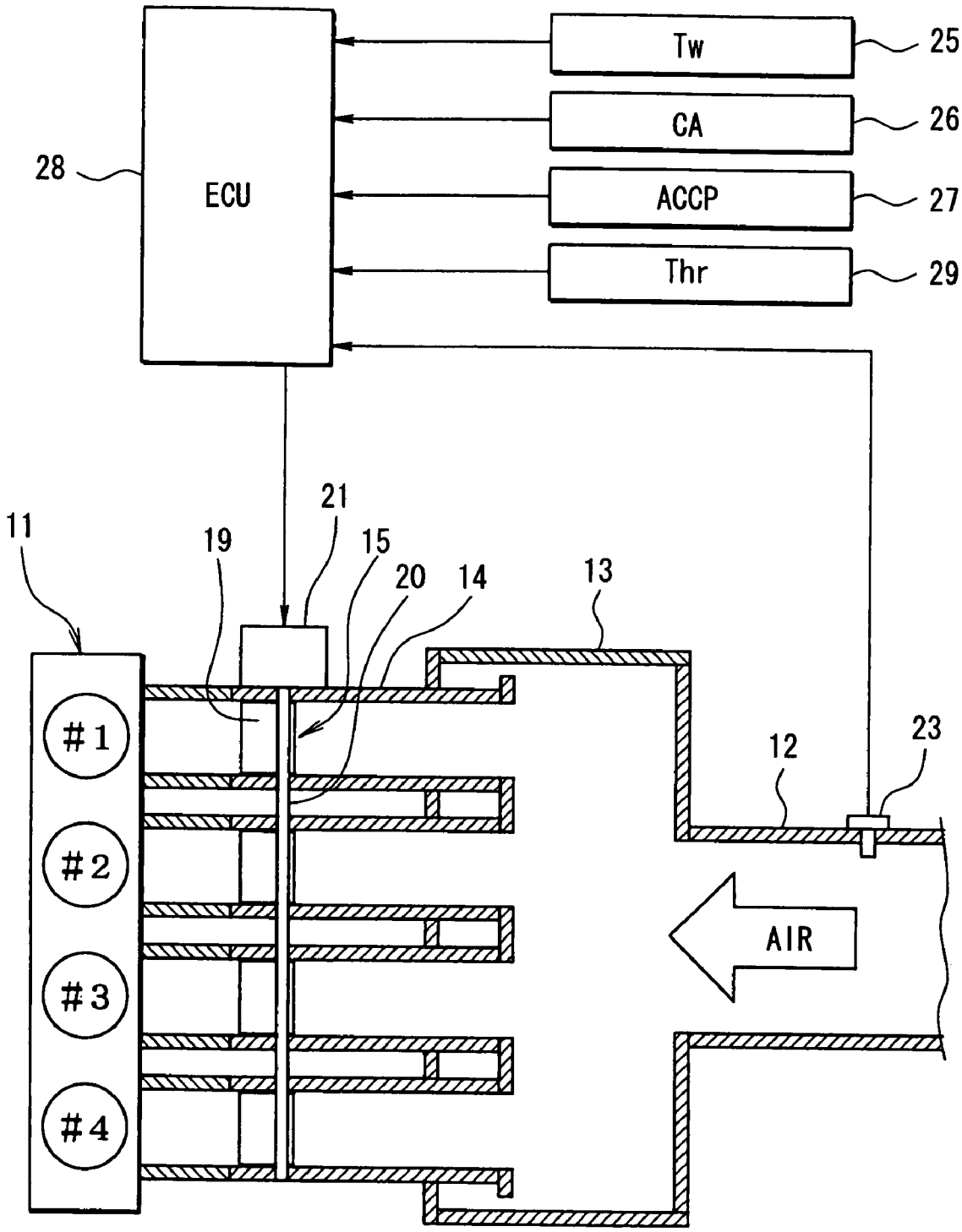
FIG. 1 is a schematic diagram showing an engine control system according to a first embodiment of the present invention.

A first embodiment of the present invention will be explained in reference to FIGS. 1 to 9. First, a schematic structure of an engine intake system will be explained with reference to FIG. 1. An engine 11 (for example, inline four-cylinder engine) as an internal combustion engine has four cylinders of a first cylinder #1 to a fourth cylinder #4. An airflow meter 23 (intake air quantity sensor) that senses an intake air quantity is provided in an intake pipe 12 (main intake passage) of the engine 11. A surge tank 13 is provided downstream of the airflow meter 23, and intake manifolds 14 (branch intake passages) for introducing air into respective cylinders of the engine 11 are provided to the surge tank 13. Intake throttle valve units 15 are attached to the intake manifolds 14 of the respective cylinders, and injectors (not shown) for injecting fuel are attached near intake ports of the respective cylinders. Spark plugs (not shown) are attached to a cylinder head of the engine 11 for the respective cylinders. A fuel air mixture in the cylinders is ignited with spark discharge from the respective spark plugs.

A coolant temperature sensor 25 for sensing coolant temperature Tw and a crank angle sensor 26 for outputting a pulse signal every time a crankshaft of the engine 11 rotates by a predetermined crank angle are attached to a cylinder block of the engine 11. A crank angle CA and engine rotation speed Ne are sensed based on the output signal of the crank angle sensor 26. An accelerator sensor 27 senses an accelerator operation amount ACCP (depressed amount of accelerator).

Figure 2:
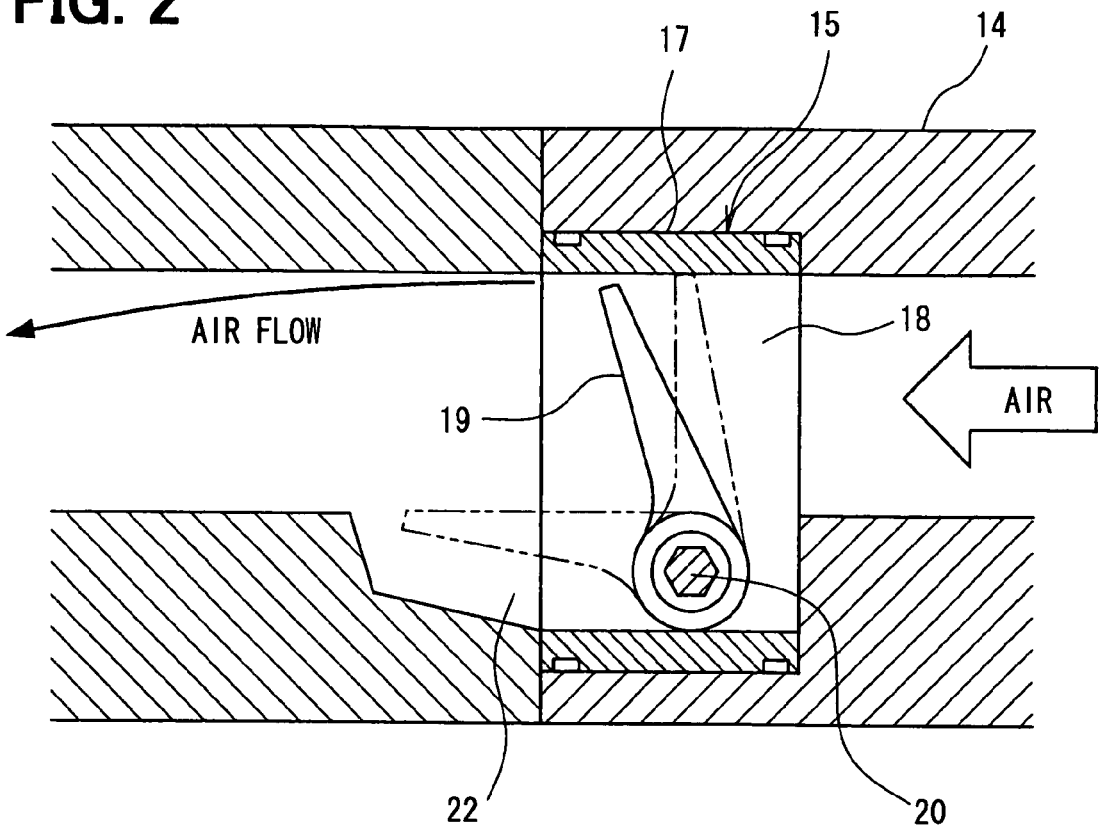
FIG. 2 is a longitudinal cross-sectional view showing an intake throttle valve unit and a proximity thereof according to the first embodiment.

Next, the structure of the intake throttle valve unit 15 will be explained in reference to FIG. 2. In the intake throttle valve unit 15 of each cylinder, an intake passage 18 with a substantially quadrangular cross-section is formed in a housing 17 made of a resin. An intake throttle valve 19 of a cantilever type for opening and closing the intake passage 18 is provided in the intake passage 18. A shaft 20 as a rotary shaft is attached to a lower end portion of the intake throttle valve 19 such that the intake throttle valve 19 can rotate about the shaft 20 in an opening direction and a closing direction. Each intake throttle valve 19 is formed in the shape that matches with the cross-sectional shape of the intake passage 18 (i.e., substantially quadrangular shape in the present embodiment). The cross-sectional shape of the intake passage 18 or the shape of the intake throttle valve 19 is not limited to the substantially quadrangular shape. Rather, the cross-sectional shape or the shape may be any other shape such as substantially a semi-circular shape or substantially a half-elliptical shape.

The intake throttle valves 19 of the respective cylinders are connected to the common shaft 20 and rotate integrally. A motor 21 (shown in FIG. 1) connected to the shaft 20 is controlled in accordance with an engine operation condition (accelerator operation amount ACCP and the like) to control an opening degree Thr of the intake throttle valves 19 of the cylinders. The opening degree Thr of the intake throttle valves 19 is sensed with an intake throttle valve opening degree sensor 29 (shown in FIG. 1).

The intake throttle valve 19 of each cylinder is provided such that an end (lower end) on the shaft 20 side thereof contacts (or is located near) an inner wall face of the housing 17 and such that the intake air can hardly pass under the intake throttle valve 19. When the intake throttle valve 19 is opened, a flow passage (gap between intake throttle valve 19 and inner wall face of housing 17) of the intake air is formed only above the intake throttle valve 19 and a flow passage cross-sectional area above the intake throttle valve 19 changes in accordance with the opening degree Thr of the intake throttle valve 19. During low load operation of the engine 11, in which the opening degree Thr of the intake throttle valve 19 becomes comparatively small, an airflow (for example, tumble flow or swirl flow) for equalizing the fuel-air mixture in the cylinder can be generated by passing the intake air only through the upper portion of the intake passage 18 and by increasing flow velocity of the intake air. An accommodation recess 22 for accommodating the intake throttle valve 19 when the intake throttle valve 19 is fully opened is formed in the housing 17 and a neighborhood thereof such that the intake throttle valve 19 does not hinder the intake air flow when the intake throttle valve 19 is fully opened.

Outputs of the above-described various sensors are inputted into a control circuit 28 (ECU). The ECU 28 is constituted mainly by a microcomputer. The ECU 28 controls a fuel injection quantity of the injector and ignition timing of the spark plug in accordance with the engine operation state by executing various kinds of engine control programs stored in an incorporated ROM (storage medium).

Furthermore, the ECU 28 calculates a target opening degree of the intake throttle valve 19 based on the accelerator operation amount ACCP sensed with the accelerator sensor 27 and the like and controls the motor 21 of the intake throttle valve 19 to coincide the actual opening degree Thr of the intake throttle valve 19 with the target opening degree.

Figure 3:
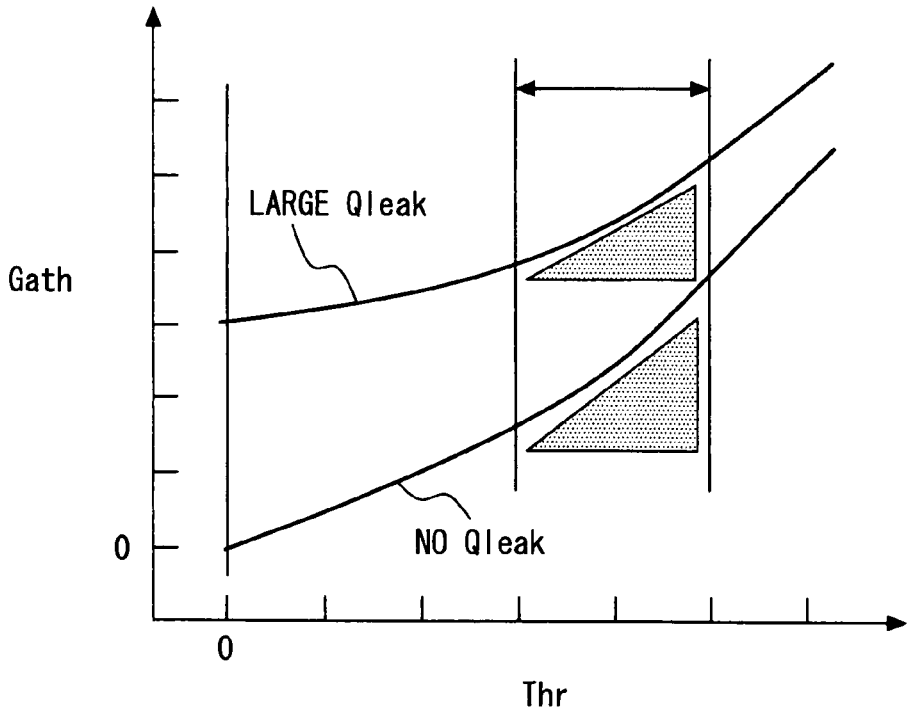
FIG. 3 is a diagram showing a relationship between a leak air quantity and an opening degree of the intake throttle valve.

As shown in FIG. 3, specifically in the low opening degree range of the intake throttle valve 19 (for example, in idle operation range), if a leak air quantity Qleak of the intake throttle valve 19 increases, a passing air quantity Gath of the intake throttle valve 19 can increase and the intake air quantity can increase even when the opening degree Thr of the intake throttle valve 19 is the same. The leak air quantity Qleak is an air quantity passing through the gap between the intake throttle valve 19 and the inner wall face of the intake passage when the intake throttle valve 19 is fully closed. Therefore, there is a possibility that the rotation of the engine 11 rises during the idle operation. If the leak air quantity Qleak of the intake throttle valve 19 decreases, the passing air quantity Gath of the intake throttle valve 19 decreases and the intake air quantity decreases even when the opening degree Thr of the intake throttle valve 19 is the same. Therefore, there is a possibility that the rotation of the engine falls. Moreover, if the leak air quantity Qleak of the intake throttle valve 19 changes, the relationship between the opening degree Thr of the intake throttle valve 19 and the passing air quantity Gath (change characteristic of passing air quantity Gath with respect to opening degree Thr of intake throttle valve 19) changes. Accordingly, there is a problem that the control accuracy of the intake air quantity by the opening degree control of the intake throttle valve 19 falls.

Figure 4:
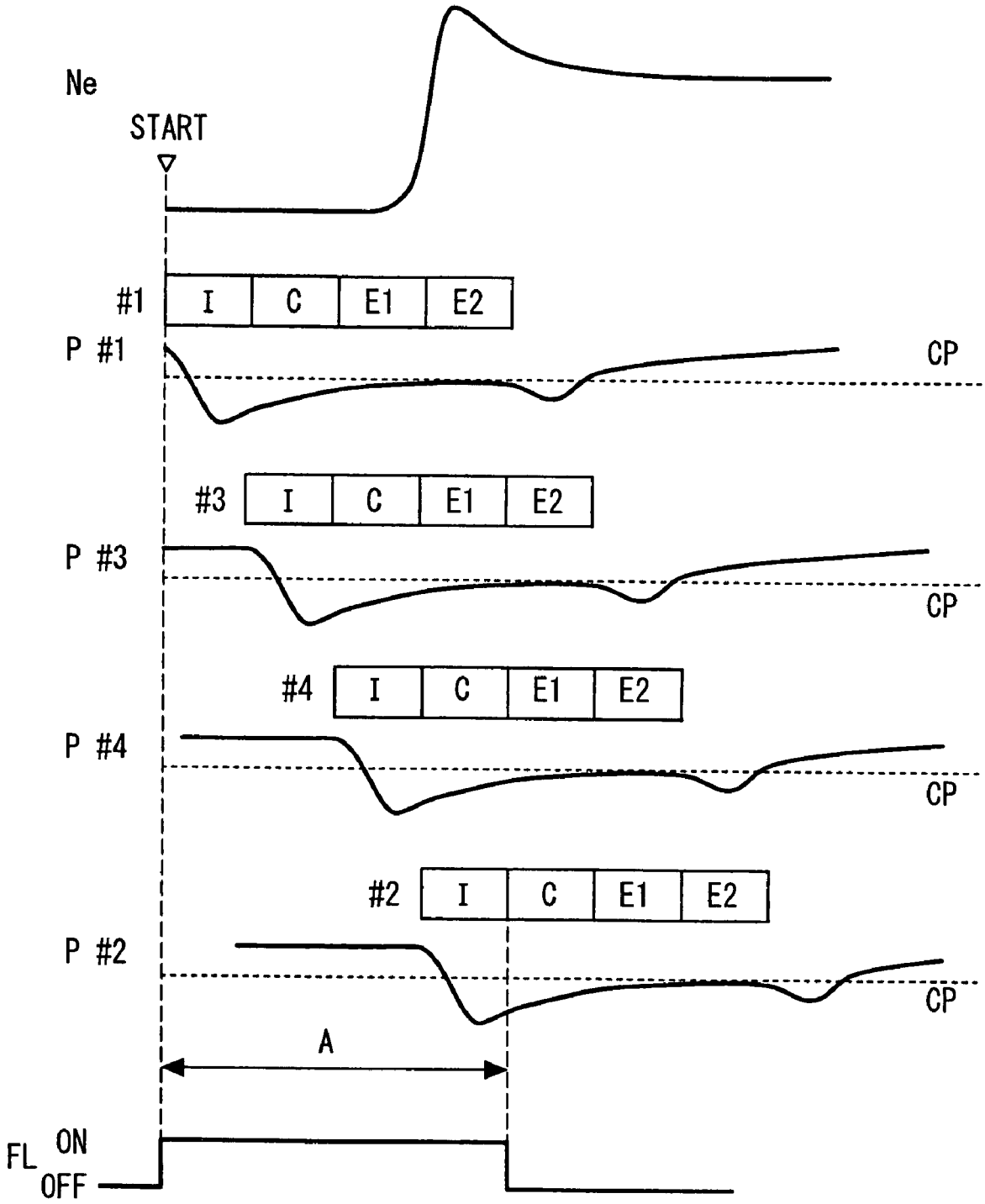
FIG. 4 is a time chart for explaining a calculation method of the leak air quantity according to the first embodiment.
Figure 6:
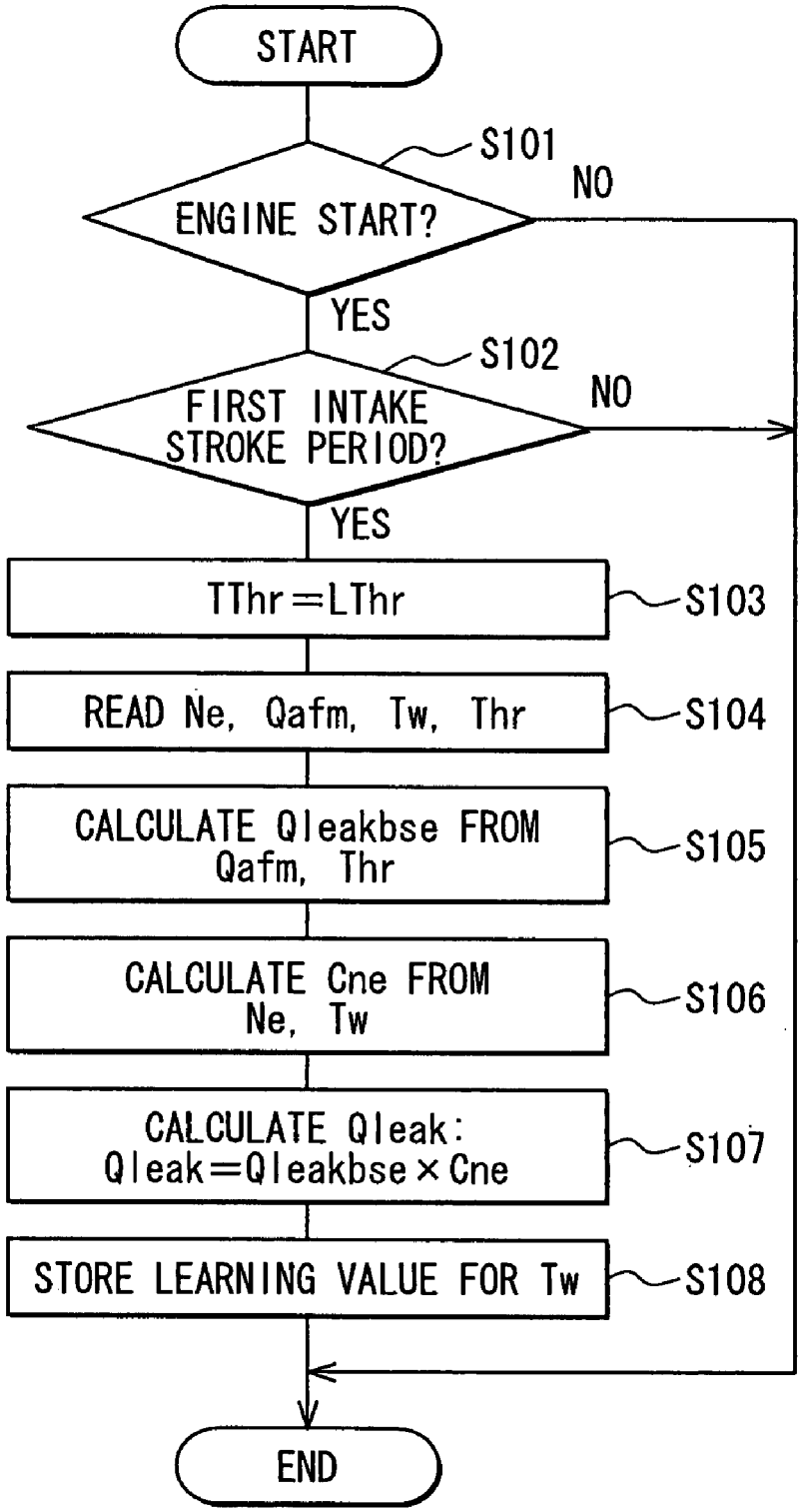
FIG. 6 is a flowchart showing a processing flow of a leak air quantity calculation program according to the first embodiment.

As a countermeasure, the ECU 28 first executes a leak air quantity calculation program shown in FIG. 6 to calculate the leak air quantity Qleak of the intake throttle valve 19 as follows. As shown in a time chart of FIG. 4, low opening degree control is performed during a first intake stroke period A since the engine start (START) is commenced until the first intake strokes of the cylinders end. The low opening degree control is for controlling the opening degree Thr of the intake throttle valve 19 to a certain opening degree for the low opening degree control (fully closed position or proximity of fully closed position) such that the pressure downstream of the intake throttle valve 19 becomes pressure equal to or lower than predetermined critical pressure CP with respect to the intake pressure upstream of the intake throttle valve 19, i.e., pressure at which the passing air quantity Gath changes in accordance with the opening degree Thr of the intake throttle valve 19 without being affected by the pressure difference between the pressure upstream of the intake throttle valve 19 and the pressure downstream of the intake throttle valve 19, during the intake stroke of each cylinder. In FIG. 4, P#1-P#4 represent the intake pressure of the first to fourth cylinders #1-#4 respectively, and FL represents a low opening degree control execution flag. I, C, E1 and E2 represent the intake stroke, a compression stroke, an expansion stroke and an exhaustion stroke of each cylinder respectively.

Next, a setting method of the opening degree for the low opening degree control, i.e., the opening degree at which the intake pressure downstream of the intake throttle valve 19 becomes the pressure equal to or lower than the critical pressure CP with respect to the intake pressure upstream of the intake throttle valve 19, will be explained. In following Formula (1) of an orifice, if fcom(Pim/Pamb) becomes constant, the passing air quantity Gath of the intake throttle valve 19 changes in accordance with the opening degree (effective flow passage cross-sectional area Aeff) of the intake throttle valve 19, without being affected by the pressure difference between the intake pressure Pamb upstream of the intake throttle valve 19 and the intake pressure Pim downstream of the intake throttle valve 19. In Formula (1), Cth represents the flow rate coefficient, R is the gas constant, and T is intake temperature.

$$Gath = Cth \times \frac{Aeff \times Pamb}{\sqrt{R \times T}} \times fcom(Pim/Pamb) \quad \text{Formula (1)}$$

Figure 5:
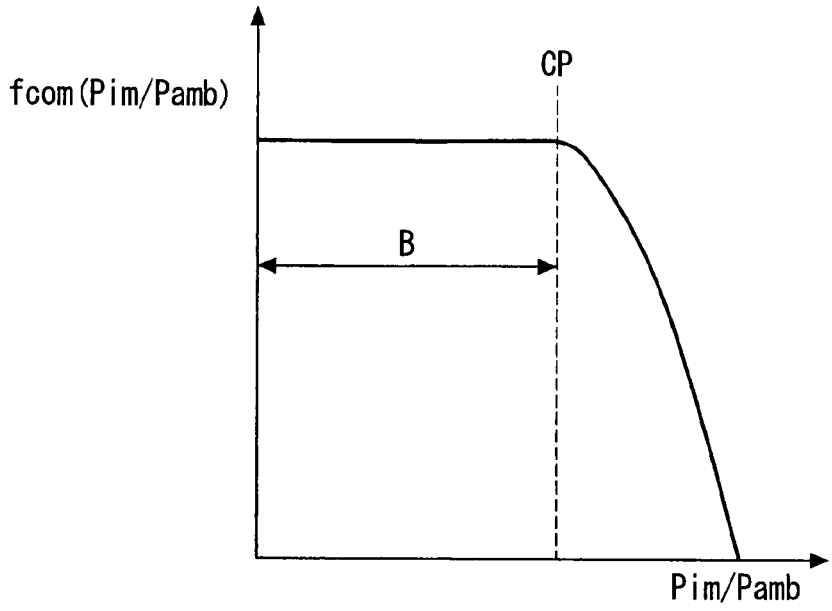
FIG. 5 is a diagram showing a pressure range equal to or lower than critical pressure.

Therefore, in the relationship (shown in FIG. 5) between Pim/Pamb and fcom(Pim/Pamb) defined by following Formulas (2), (3) of an isentropic flow, a range B shown in FIG. 5 where fcom(Pim/Pamb) is constant is a range where the intake pressure Pim downstream of the intake throttle valve 19 becomes the pressure equal to or lower than the critical pressure CP with respect to the intake pressure Pamb upstream of the intake throttle valve 19. κ in Formulas (2), (3) is the specific heat ratio.

$$fcom(Pim/Pamb) = \sqrt{\kappa \times \left(\frac{2}{\kappa+1}\right)^{\frac{\kappa+1}{\kappa-1}}} \quad \text{when } Pim \le \left(\frac{2}{\kappa+1}\right)^{\frac{\kappa}{\kappa-1}} \times Pamb \quad \text{Formula (2)}$$

$$fcom(Pim/Pamb) = \sqrt{\frac{2 \times \kappa}{\kappa-1}\left(\left(\frac{Pim}{Pamb}\right)^{\frac{2}{\kappa}} - \left(\frac{Pim}{Pamb}\right)^{\frac{\kappa+1}{\kappa}}\right)} \quad \text{when } Pim > \left(\frac{2}{\kappa+1}\right)^{\frac{\kappa}{\kappa+1}} \times Pamb \quad \text{Formula (3)}$$

Therefore, the opening degree for the low opening degree control can be set by calculating the opening degree Thr of the intake throttle valve 19 that satisfies following Formula (4) as a condition that makes fcom(Pim/Pamb) constant, i.e., a condition that satisfies Formula (2) of the isentropic flow.

$$Pim \le \left(\frac{2}{\kappa+1}\right)^{\frac{\kappa}{\kappa+1}} \times Pamb \quad \text{Formula (4)}$$

The intake air quantity is sensed with the airflow meter 23 during the execution of the low opening degree control for controlling the opening degree Thr of the intake throttle valve 19 to the opening degree for the low opening degree control. Based on the intake air quantity sensed with the airflow meter 23, the leak air quantity Qleak at the time when the intake throttle valve 19 is fully closed is calculated.

Thus, the passing air quantity Gath corresponding to the opening degree Thr of the intake throttle valve 19 during the low opening degree control can be sensed by sensing the intake air quantity with the airflow meter 23 during the low opening degree control. During the low opening degree control, the passing air quantity Gath changes in accordance with the opening degree of the intake throttle valve 19, without being affected by the pressure difference between the pressure upstream of the intake throttle valve 19 and the pressure downstream of the intake throttle valve 19. Therefore, by using a map or the like beforehand storing the relationship between the opening degree of the intake throttle valve 19 and the passing air quantity Gath during the low opening degree control, the leak air quantity Qleak as the passing air quantity Gath at the time when the intake throttle valve 19 is fully closed can be calculated with high accuracy from the intake air quantity sensed with the airflow meter 23 during the low opening degree control, i.e., the passing air quantity Gath corresponding to the opening degree Thr of the intake throttle valve 19 for the low opening degree control.

Figure 7:
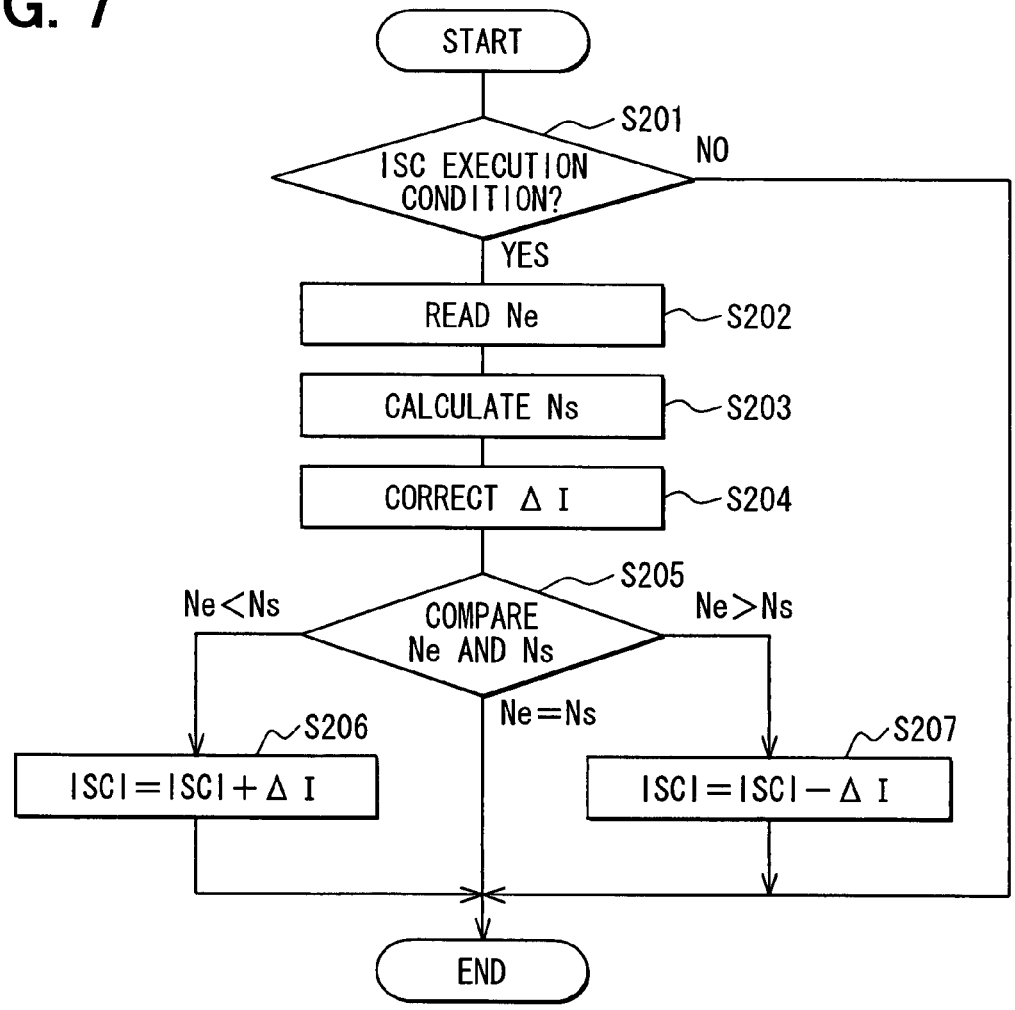
FIG. 7 is a flowchart showing a processing flow of ISC feedback correction amount calculation program according to the first embodiment.

Furthermore, the ECU 28 executes an ISC (idling speed control) feedback correction amount calculation program shown in FIG. 7 to calculate an ISC feedback correction amount ISCI for conforming actual engine rotation speed to target idle speed when a predetermined ISC execution condition is satisfied. The ECU 28 controls the motor 21 of the intake throttle valve 19 with the use of the ISC feedback correction amount ISCI to perform ISC (idle speed control) for feedback-controlling the opening degree Thr of the intake throttle valve 19.

The ECU 28 corrects an integration amount ΔI (feedback gain of ISC) of the ISC feedback correction amount ISCI in accordance with the leak air quantity. Qleak of the intake throttle valve 19 to correct the opening degree Thr of the intake throttle valve 19 in accordance with the leak air quantity Qleak of the intake throttle valve 19. Thus, the change in the relationship between the opening degree Thr of the intake throttle valve 19 and the passing air quantity Gath (change characteristic of passing air quantity Gath with respect to opening degree Thr of intake throttle valve 19) due to the change of the leak air quantity Qleak of the intake throttle valve 19 is compensated to improve stability of the idle speed.

Next, contents of processing of the leak air quantity calculation program of FIG. 6 and the ISC feedback correction amount calculation program of FIG. 7 executed by the ECU 28 will be explained. The leak air quantity calculation program shown in FIG. 6 is executed in a predetermined cycle while the ECU 28 is energized. If the program is started, first, S101 determines whether the engine start is in progress. If S101 is YES, the processing proceeds to S102. S102 determines whether the present time is in the first intake stroke period since the engine start is commenced until the first intake strokes of the respective cylinders are completed.

If S102 is YES, the processing proceeds to S103 to set the target opening degree TThr of the intake throttle valve 19 at the opening degree LThr for the low opening degree control. The opening degree LThr for the low opening degree control is the opening degree Thr with which the intake pressure downstream of the intake throttle valve 19 becomes the pressure equal to or lower than the critical pressure CP with respect to the intake pressure upstream of the intake throttle valve 19 (i.e., pressure at which passing air quantity Gath changes in accordance with opening degree of intake throttle valve 19 without being affected by pressure difference between pressure upstream of intake throttle valve 19 and pressure downstream of intake throttle valve 19) during the intake stroke of each cylinder.

S103 sets the target opening degree TThr of the intake throttle valve 19 at the opening degree LThr for the low opening degree control to control the actual opening degree Thr of the intake throttle valve 19 to the opening degree LThr for the low opening degree control (target opening degree TThr). Thus, the low opening degree control for controlling the opening degree of the intake throttle valve 19 so that the intake pressure downstream of the intake throttle valve 19 becomes the pressure equal to or lower than the critical pressure CP with respect to the intake pressure upstream of the intake throttle valve 19 in the intake stroke of each cylinder is performed.

Then, the processing proceeds to S104 to read the intake air quantity Qafm, the engine rotation speed Ne, the coolant temperature Tw and the actual opening degree Thr of the intake throttle valve 19 sensed with the airflow meter 23, the crank angle sensor 26, the coolant temperature sensor 25 and the intake throttle valve opening degree sensor 29 during the low opening degree control, and the like.

Figures 8, 9:
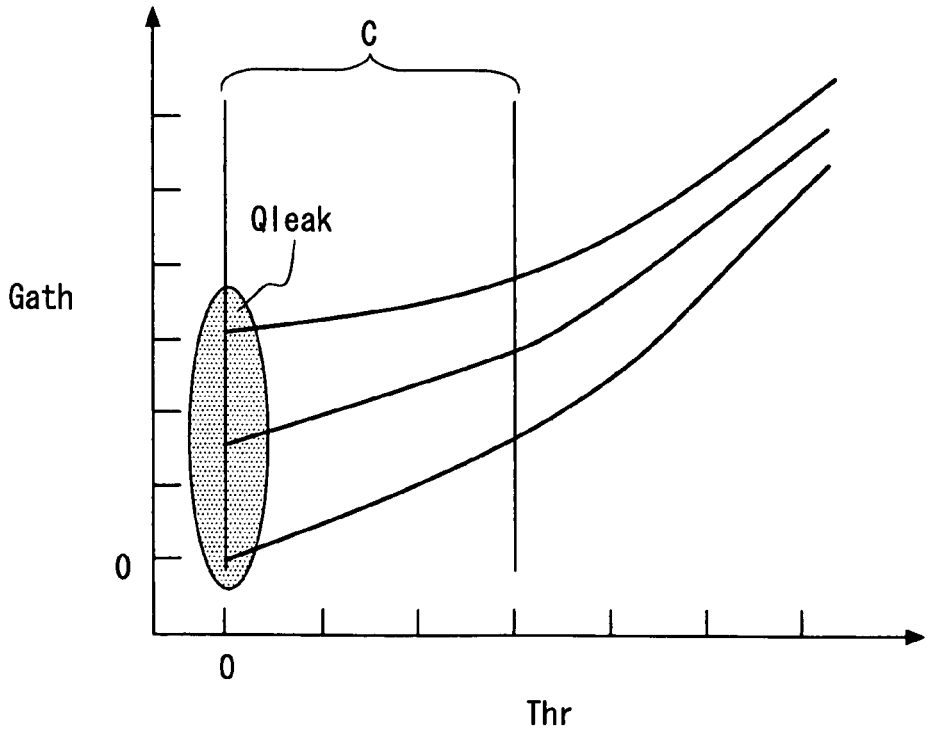
FIG. 8 is a map showing a basic leak air quantity according to the first embodiment.
FIG. 9 is a map showing a relationship between the opening degree of the intake throttle valve and a passing air quantity during low opening degree control according to the first embodiment.

Then, the processing proceeds to S105 to calculate a basic leak air quantity Qleakbse at the time when the intake throttle valve 19 is fully closed in accordance with the intake air quantity Qafm and the actual opening degree Thr of the intake throttle valve 19 of the present time (i.e.,during low opening degree control) with reference to a map of the basic leak air quantity Qleakbse shown in FIG. 8. The map of the basic leak air quantity Qleakbse shown in FIG. 8 is set based on the relationship (in range C shown in FIG. 9) between the opening degree Thr of the intake throttle valve 19 and the passing air quantity Gath during the low opening degree control (i.e., in state where passing air quantity Gath changes in accordance with opening degree of intake throttle valve 19 without being affected by pressure difference between pressure upstream of intake throttle valve 19 and pressure downstream of intake throttle valve 19) beforehand obtained based on test data, design data and the like. For example, the map of the basic leak air quantity Qleakbse is set such that the basic leak air quantity Qleakbse increases as the intake air quantity Qafm during the low opening degree control increases and the basic leak air quantity Qleakbse increases as the actual opening degree Thr of the intake throttle valve 19 during the low opening degree control decreases.

Then, the processing proceeds to S106 to calculate a correction coefficient Cne corresponding to the engine rotation speed Ne and the coolant temperature Tw with reference to a map of the correction coefficient Cne (not shown). The map of the correction coefficient Cne is set based on the relationship between the engine rotation speed Ne and the leak air quantity Qleak at the time when the intake throttle valve 19 is fully closed and the relationship between the coolant temperature Tw and the leak air quantity Qleak at the time when the intake throttle valve 19 is fully closed, which are beforehand obtained based on test data, design data and the like.

Then, the processing proceeds to S107 to calculate the leak air quantity Qleak at the time when the intake throttle valve 19 is fully closed by multiplying the basic leak air quantity Qleakbse at the time when the intake throttle valve 19 is fully closed by the correction coefficient Cne (i.e., Qleak=Qleakbse×Cne).

Then, the processing proceeds to S108. S108 updates the learning value of the leak air quantity Qleak in a learning area corresponding to the coolant temperature Tw as of the calculation of the present leak air quantity Qleak with the presently calculated leak air quantity Qleak and stores the learning value in a rewritable nonvolatile memory such as a backup RAM (not shown) of the ECU 28.

The ISC feedback correction amount calculation program shown in FIG. 7 is executed in a predetermined cycle while the ECU 28 is energized. If the program is started, S201 first determines whether the ISC execution condition is satisfied, for example, based on whether all conditions including a condition that the intake throttle valve 19 is fully closed, a condition that vehicle speed is equal to or lower than a predetermined value and a condition that the engine rotation speed Ne is within a predetermined range are satisfied.

If S201 determines that the ISC execution condition is satisfied, the processing proceeds to S202 to read the actual engine rotation speed Ne sensed with the crank angle sensor 26. Then, the processing proceeds to S203 to calculate target idle speed Ns corresponding to the present coolant temperature Tw with reference to a map of the target idle speed Ns (not shown).

Then, the processing proceeds to S204 to correct the integration amount ΔI of the ISC feedback correction amount ISCI in accordance with the leak air quantity Qleak at the time when the intake throttle valve 19 is fully closed. In this case, the integration amount ΔI is corrected to correct the change in the relationship between the opening degree Thr of the intake throttle valve 19 and the passing air quantity Gath (change characteristic of passing air quantity with respect to opening degree Thr of intake throttle valve) due to the change of the leak air quantity Qleak of the intake throttle valve 19.

Then, the processing proceeds to S205 to compare the actual engine rotation speed Ne and the target idle speed Ns. If it is determined that the actual engine rotation speed Ne is lower than the target idle speed Ns, the processing proceeds to S206 to perform the correction for increasing the ISC feedback correction amount ISCI by the integration amount ΔI (i.e., ISCI=ISCI+ΔI).

If it is determined that the actual engine rotation speed Ne is higher than the target idle speed Ns, the processing proceeds to S207 to perform correction for decreasing the ISC feedback correction amount ISCI by the integration amount ΔI (i.e., ISCI=ISCI−ΔI).

The above-described first embodiment performs the low opening degree control for controlling the opening degree of the intake throttle valve 19 to the fully closed position or the proximity of the fully closed position during the first intake stroke period since the engine start is commenced until the first intake strokes of the respective cylinders are completed. Thus, the intake pressure downstream of the intake throttle valve 19 is brought to the pressure equal to or lower than the critical pressure with respect to the intake pressure upstream of the intake throttle valve 19, i.e., the pressure at which the passing air quantity changes in accordance with the opening degree of the intake throttle valve 19 without being affected by the pressure difference between the pressure upstream of the intake throttle valve 19 and the pressure downstream of the intake throttle valve 19. The leak air quantity as the passing air quantity at the time when the intake throttle valve 19 is fully closed is calculated based on the intake air quantity sensed with the airflow meter 23 during the low opening degree control (i.e., passing air quantity corresponding to opening degree of intake throttle valve 19 during low opening degree control) and the opening degree of the intake throttle valve 19. Accordingly, the leak air quantity of the intake throttle valve 19 can be calculated with high accuracy.

The air is stored in the intake passage downstream of the intake throttle valve 19 before the first intake stroke of each cylinder ends after the engine start is commenced. Therefore, even if the low opening degree control for controlling the opening degree of the intake throttle valve 19 to the fully closed position or the proximity of the fully closed position is performed during the first intake stroke period since the engine start is commenced until the first intake strokes of the cylinders are completed, the air necessary for the combustion in the engine start can be suctioned into the cylinders, inhibiting adverse effect on the starting performance of the engine 11.

The first embodiment corrects the integration amount ΔI of the ISC feedback correction amount ISCI in accordance with the leak air quantity of the intake throttle valve 19 during the idle operation to correct the opening degree Thr of the intake throttle valve 19 in accordance with the leak air quantity of the intake throttle valve 19. Thus, the change in the relationship between the opening degree Thr of the intake throttle valve 19 and the passing air quantity Gath (change characteristic of passing air quantity Gath with respect to opening degree Thr of intake throttle valve) due to the change in the leak air quantity Qleak of the intake throttle valve 19 is compensated. Accordingly, the controllability of the intake air quantity through the opening degree control of the intake throttle valve 19 can be improved and the stability of the idle speed can be improved without being affected by the aging change of the leak air quantity of the intake throttle valve 19 and the like.

Furthermore, in the first embodiment, the leak air quantity of the intake throttle valve 19 can be calculated when the engine 11 is started. Therefore, the correction of the opening degree of the intake throttle valve 19 according to the leak air quantity of the intake throttle valve 19 can be started immediately after the engine start. As a result, the controllability of the intake air quantity can be improved even immediately after the engine start.

Figure 10:
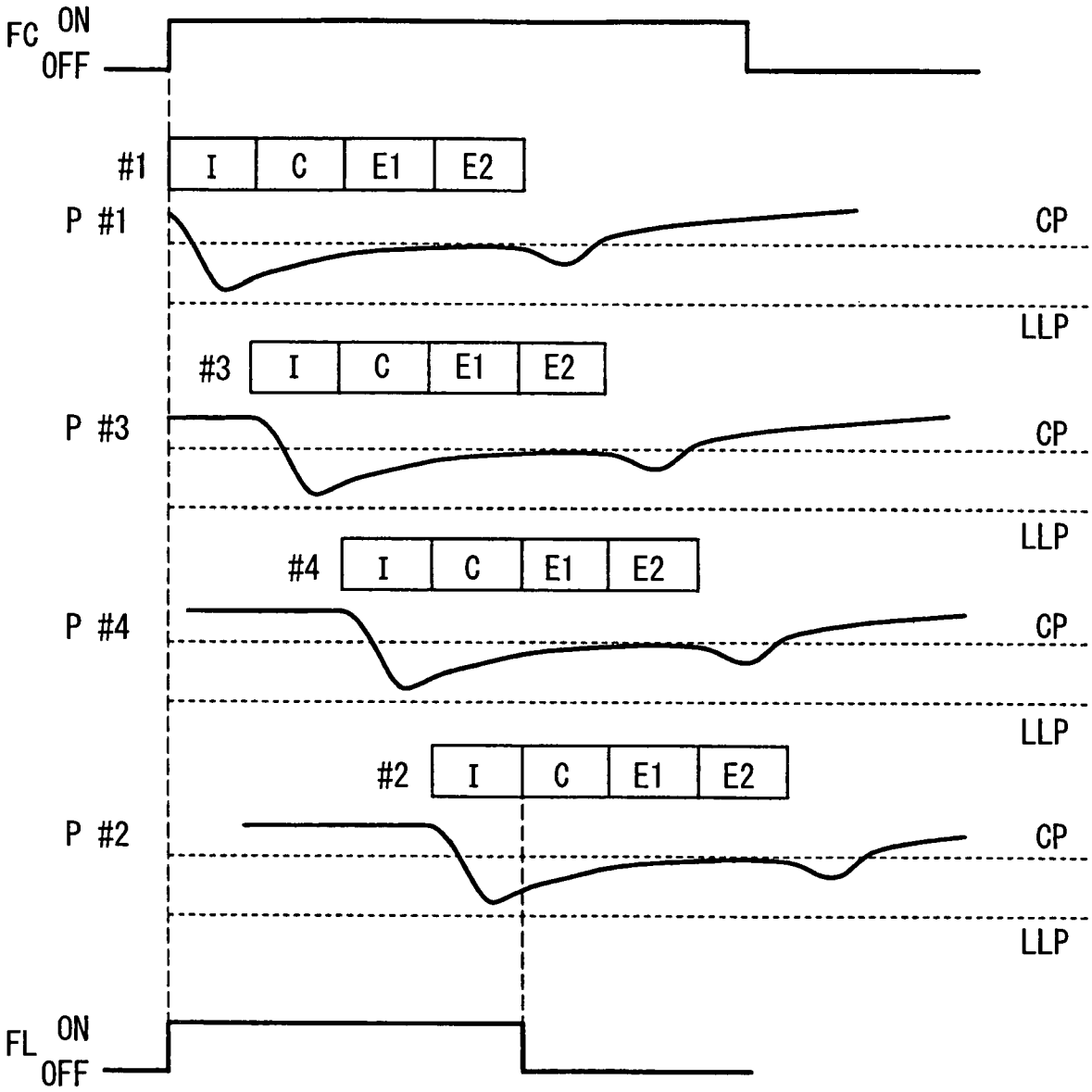
FIG. 10 is a time chart for explaining a calculation method of a leak air quantity according to a second embodiment of the present invention.
Figure 11:
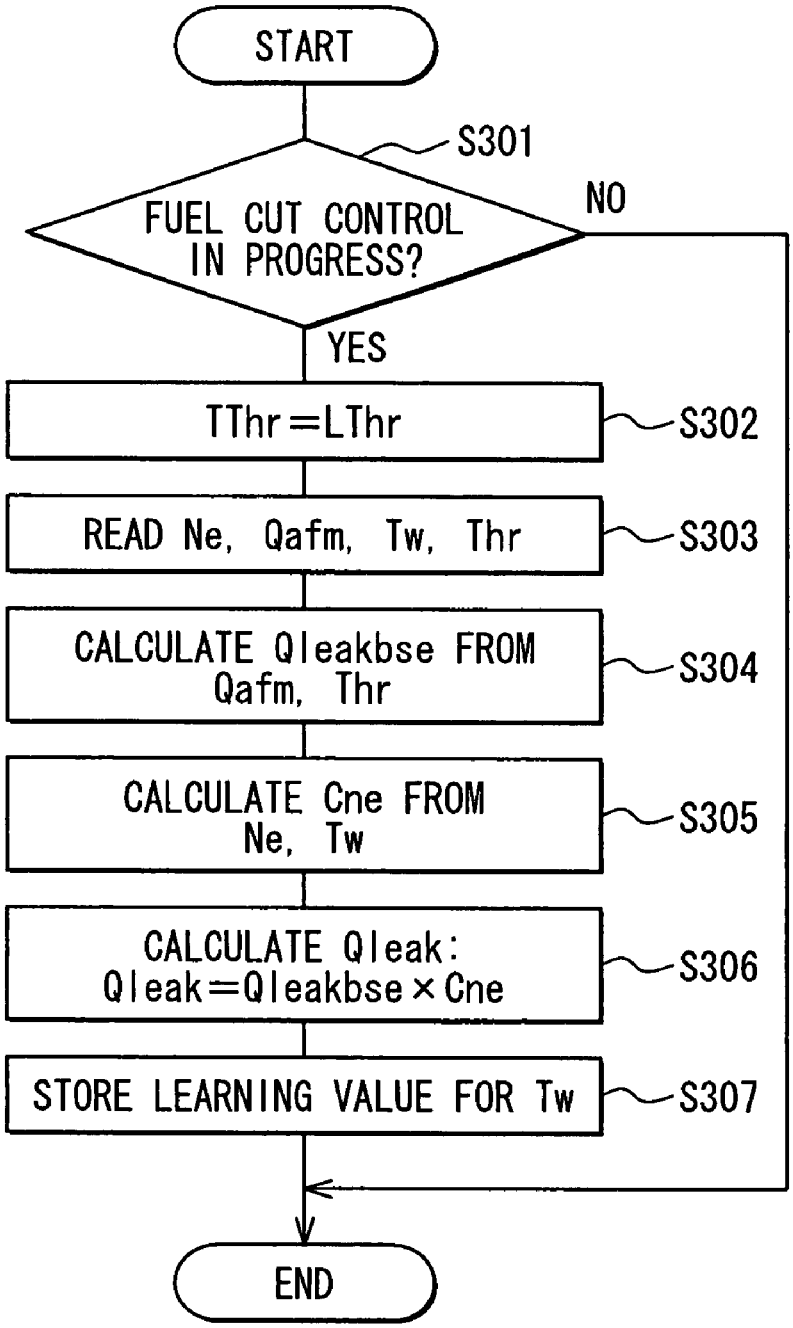
FIG. 11 is a flowchart showing a processing flow of a leak air quantity calculation program according to the second embodiment.

Next, a second embodiment of the present invention will be explained in reference to FIGS. 10 and 11. In the second embodiment, a leak air quantity calculation program shown in FIG. 11 is executed to perform low opening degree control for controlling the opening degree of the intake throttle valve 19 to the fully closed position or proximity of the fully closed position during fuel cut control for suspending the fuel injection of the engine 11 as shown in a time chart of FIG. 10. Thus, the intake pressure downstream of the intake throttle valve 19 is brought to pressure that is equal to or lower than the critical pressure with respect to the intake pressure upstream of the intake throttle valve 19 and that does not cause oil loss via valve guides in the intake stroke of each cylinder. FC in FIG. 10 represents a fuel cut control execution flag. The leak air quantity Qleak at the time when the intake throttle valve 19 is fully closed is calculated based on the intake air quantity Qafm sensed with the airflow meter 23 during the low opening degree control.

In the leak air quantity calculation program shown in FIG. 11, S301 first determines whether the fuel cut control is in progress. If S301 is YES, the processing proceeds to S302 to set the target opening degree TThr of the intake throttle valve 19 to the opening degree LThr for the low opening degree control. The opening degree LThr for the low opening degree control is the opening degree that brings the intake pressure downstream of the intake throttle valve 19 to the pressure that is equal to or lower than the critical pressure CP (i.e., pressure at which passing air quantity changes in accordance with opening degree of intake throttle valve 19 without being affected by pressure difference between pressure upstream of intake throttle valve 19 and pressure downstream of the intake throttle valve 19) with respect to the intake pressure upstream of the intake throttle valve 19 and that is equal to or higher than lower limit pressure LLP for preventing the oil loss via the valve guides during the intake stroke of each cylinder.

S302 sets the target opening degree TThr of the intake throttle valve 19 to the opening degree LThr for the low opening degree control to control the actual opening degree Thr of the intake throttle valve 19 to the opening degree LThr for low opening degree control (target opening degree TThr). Thus, the low opening degree control for controlling the opening degree Thr of the intake throttle valve 19 so that the intake pressure downstream of the intake throttle valve 19 becomes the pressure that is equal to or lower than the critical pressure CP with respect to the intake pressure upstream of the intake throttle valve 19 and that is equal to or higher than the lower limit pressure LLP for preventing the oil loss via the valve guides during the intake stroke of each cylinder is performed.

Then, S303 reads the intake air quantity Qafm, the engine rotation speed Ne, the coolant temperature Tw, the actual opening degree Thr of the intake throttle valve 19 and the like, which are sensed during the low opening degree control. Then, with reference to the map of the basic leak air quantity Qleakbse shown in FIG. 8, S304 calculates the basic leak air quantity Qleakbse at the time when the intake throttle valve 19 is fully closed in accordance with the intake air quantity Qafm and the actual opening degree Thr of the intake throttle valve 19 at the present time (i.e., during low opening degree control). S305 calculates the correction coefficient Cne corresponding to the engine rotation speed Ne and the coolant temperature Tw with reference to the map of the correction coefficient Cne (not shown).

Then, S306 calculates the leak air quantity Qleak at the time when the intake throttle valve 19 is fully closed by multiplying the basic leak air quantity Qleakbse at the time when the intake throttle valve 19 is fully closed by the correction coefficient Cne. Then, S307 updates the learning value of the leak air quantity Qleak in the learning area corresponding to the coolant temperature Tw as of the present calculation of the leak air quantity Qleak with the presently calculated leak air quantity Qleak and stores the learning value in the rewritable nonvolatile memory.

The capacity of the intake passage downstream of the intake throttle valve 19 is small in the system having the intake throttle valves 19 in the intake manifolds 14 of the respective cylinders of the engine 11. Therefore, if the intake throttle valve 19 is fully closed during the fuel cut control (i.e., when rotation speed of engine 11 is equal to or greater than predetermined value), there is a possibility that the intake pressure downstream of the intake throttle valve 19 declines greatly and the oil loss via the valve guides occurs.

Therefore, the second embodiment performs the low opening degree control for controlling the opening degree of the intake throttle valve 19 to the fully closed position or the proximity of the fully closed position during the fuel cut control so that the intake pressure downstream of the intake throttle valve 19 becomes the pressure that is equal to or lower than the critical pressure with respect to the intake pressure upstream of the intake throttle valve 19 and that does not cause the oil loss via the valve guides. The leak air quantity at the time when the intake throttle valve 19 is fully closed is calculated based on the intake air quantity sensed with the airflow meter 23 during the low opening degree control. Accordingly, the leak air quantity of the intake throttle valve 19 can be calculated with high accuracy while preventing the oil loss via the valve guides and the adverse effect on the operation of the engine 11.

In the first and second embodiments, the basic leak air quantity Qleakbse is calculated in accordance with the intake air quantity Qafm and the actual opening degree Thr of the intake throttle valve 19 as of the low opening degree control. Alternatively, the basic leak air quantity Qleakbse may be calculated in accordance with the intake air quantity Qafm and the target opening degree TThr (i.e., opening degree LThr for low opening degree control) of the intake throttle valve 19 as of the low opening degree control.

In the first and second embodiments, the integration amount ΔI of the ISC feedback correction amount ISCI is corrected in accordance with the leak air quantity of the intake throttle valve 19 during the idle operation. Alternatively, the opening degree of the intake throttle valve 19 may be corrected in accordance with the leak air quantity Qleak of the intake throttle valve 19 during normal operation other than the idle operation. Thus, the change in the relationship between the opening degree Thr of the intake throttle valve 19 and the passing air quantity Gath (change characteristic of passing air quantity Gath with respect to opening degree Thr of intake throttle valve) due to the change in the leak air quantity of the intake throttle valve 19 may be compensated.

Figure 12:
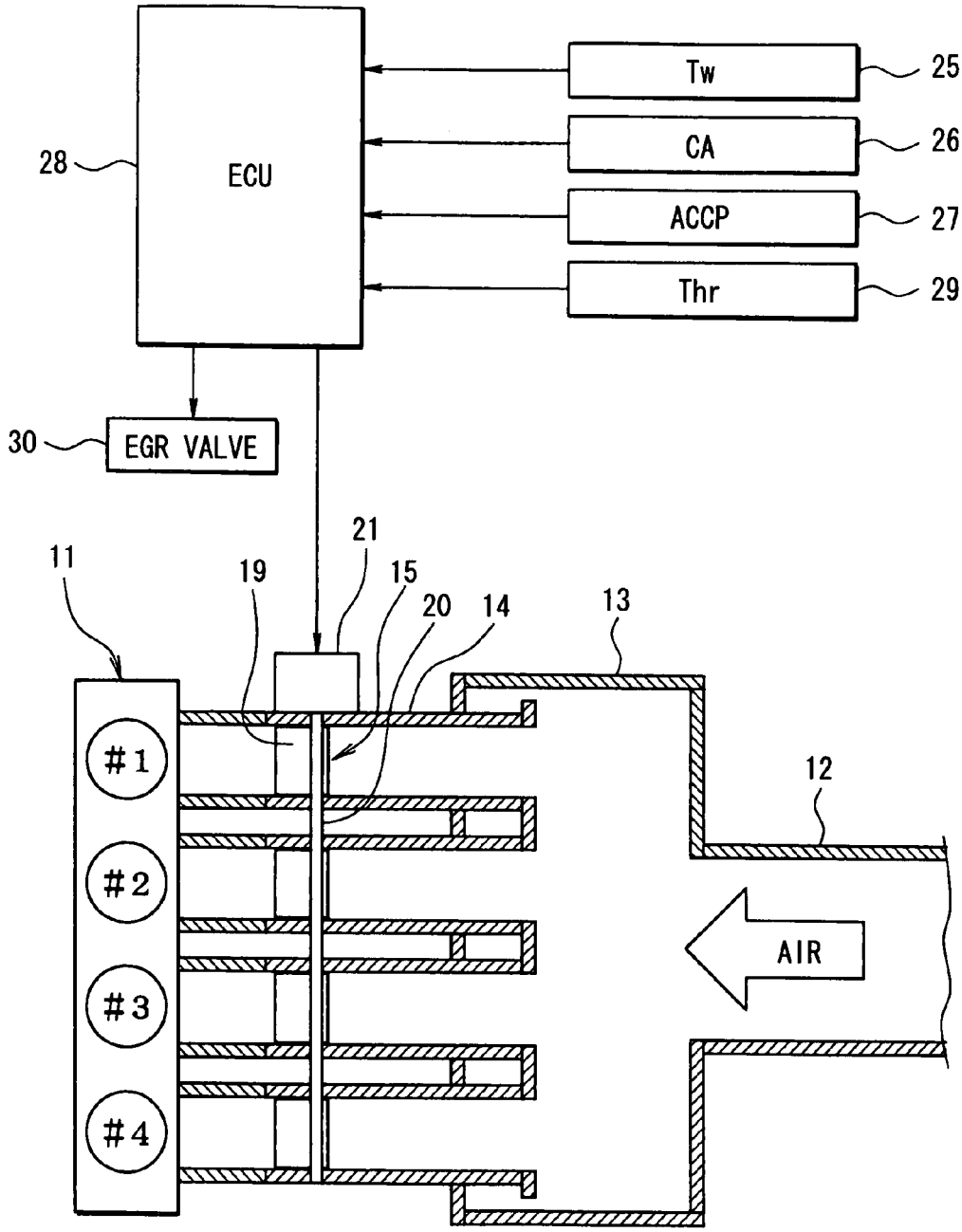
FIG. 12 is a schematic diagram showing an engine control system according to a third embodiment of the present invention.

Next, a third embodiment of the present invention will be explained. First, an outline of an engine intake system will be explained in reference to FIG. 12. The inline four-cylinder engine 11 as an internal combustion engine has four cylinders of a first cylinder #1 to a fourth cylinder #4. A surge tank 13 is provided to an intake pipe 12 of the engine 11. Intake manifolds 14 for introducing air into respective cylinders of the engine 11 are provided to the surge tank 13. Intake throttle valve units 15 are attached to the intake manifolds 14 of the respective cylinders. Injectors (not shown) for injecting fuel are provided near intake ports of the respective cylinders. Spark plugs (not shown) are attached to a cylinder head of the engine 11 for the respective cylinders. Fuel-air mixture in the cylinders is ignited with spark discharge from the respective spark plugs. An EGR valve 30 (exhaust gas recirculation adjustment device) that adjusts an EGR quantity (quantity of exhaust gas recirculation quantity) is provided in an EGR pipe (not shown) for recirculating part of exhaust gas of the engine 11 to the intake air side.

A coolant temperature sensor 25 for sensing coolant temperature Tw and a crank angle sensor 26 for outputting a pulse signal every time a crankshaft of the engine 11 rotates by a predetermined crank angle are attached to a cylinder block of the engine 11. The crank angle CA and engine rotation speed Ne are sensed based on the output signal of the crank angle sensor 26. Furthermore, an accelerator operation amount ACCP (depressed amount of accelerator) is sensed with an accelerator sensor 27.

A variation is caused among the intake air quantities of the cylinders if the leak air quantities of the intake throttle valves 19 provided in the intake manifolds 14 of the respective cylinders (air quantities passing through small gaps between intake throttle valves 19 and intake passage inner wall faces when intake throttle valves 19 are fully closed) vary among the cylinders due to manufacture tolerances, aging changes, and the like. Therefore, there is a possibility that the torque of the respective cylinders varies and the engine rotation speed fluctuates largely.

Figure 14:
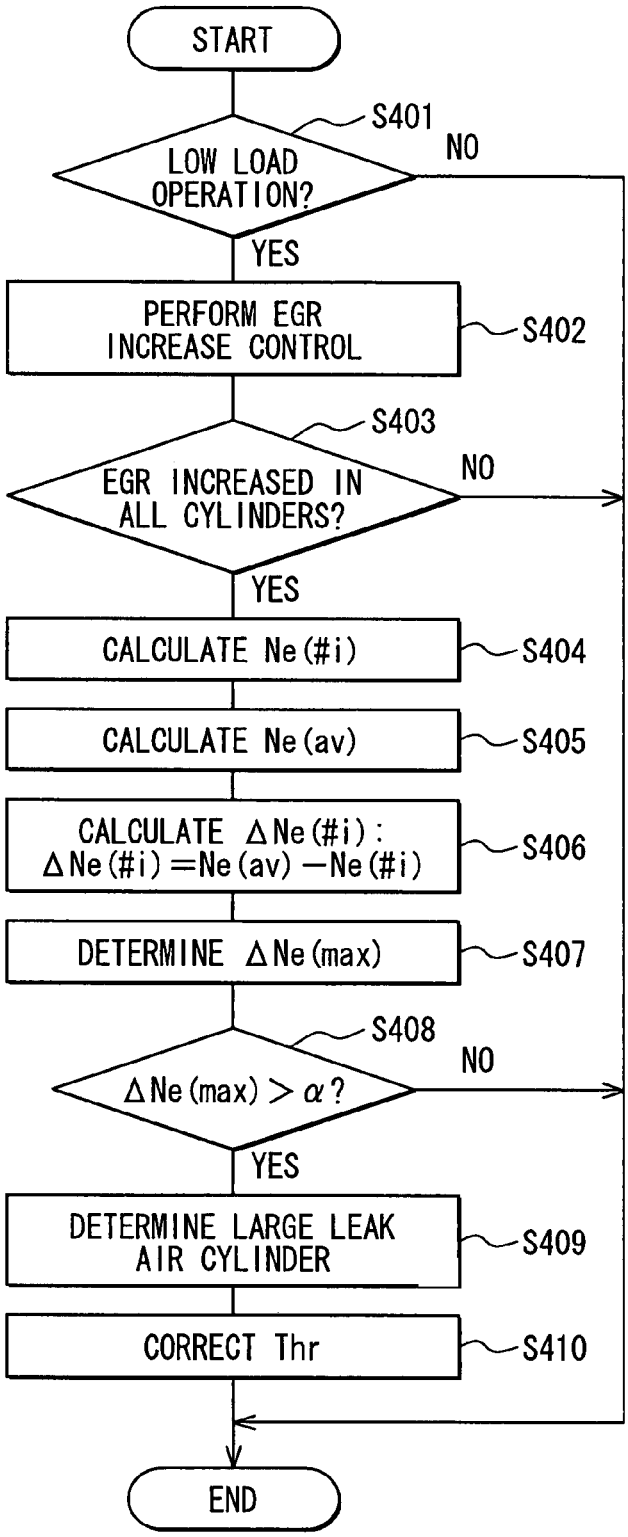
FIG. 14 is a flowchart showing a processing flow of an each cylinder intake throttle valve opening degree correction program according to the third embodiment.

As a countermeasure, the ECU 28 executes an each cylinder intake throttle valve opening degree correction program shown in FIG. 14 to perform each cylinder intake throttle valve opening degree correction for correcting the opening degree of the intake throttle valve 19 in accordance with the leak air quantity of each cylinder as follows.

If the leak air quantity of the intake throttle valve 19 increases when the intake throttle valve 19 has a function to generate an airflow current (e.g., tumble flow or swirl flow) for equalizing the fuel-air mixture, the intensity of the airflow generated by the intake throttle valve 19 is weakened correspondingly, and the effect to equalize the fuel-air mixture is lowered. Therefore, if the EGR quantity is increased during the low load operation of the engine 11, in which the influence of the EGR is large, as shown by a solid line "a" in a time chart of FIG. 13, the effect of equalizing the fuel-air mixture is further lowered by the influence of the EGR in the cylinder (for example, second cylinder #2) causing the large leak air quantity of the intake throttle valve 19. As a result, the combustion state becomes unstable and the rotation speed corresponding to the combustion stroke falls greatly over a normal variation range ΔNe(nor). A broken line "b" in FIG. 13 shows the rotation speed Ne in the case where the airflow control function is not provided.

Paying attention to such the characteristic, in the present embodiment, first, EGR increase control for controlling the EGR valve 30 to increase the EGR quantity during the low load operation of the engine 11 is performed. The rotation fluctuation due to the combustion in the respective cylinders is sensed as a parameter for evaluating the combustion states of the respective cylinders during the EGR increase control, and the cylinder causing an unstable combustion state is determined based on the rotation fluctuation due to the combustion in the respective cylinders. The cylinder causing the unstable combustion state is determined to be a large leak air cylinder (cylinder causing large leak air quantity).

Figure 13:
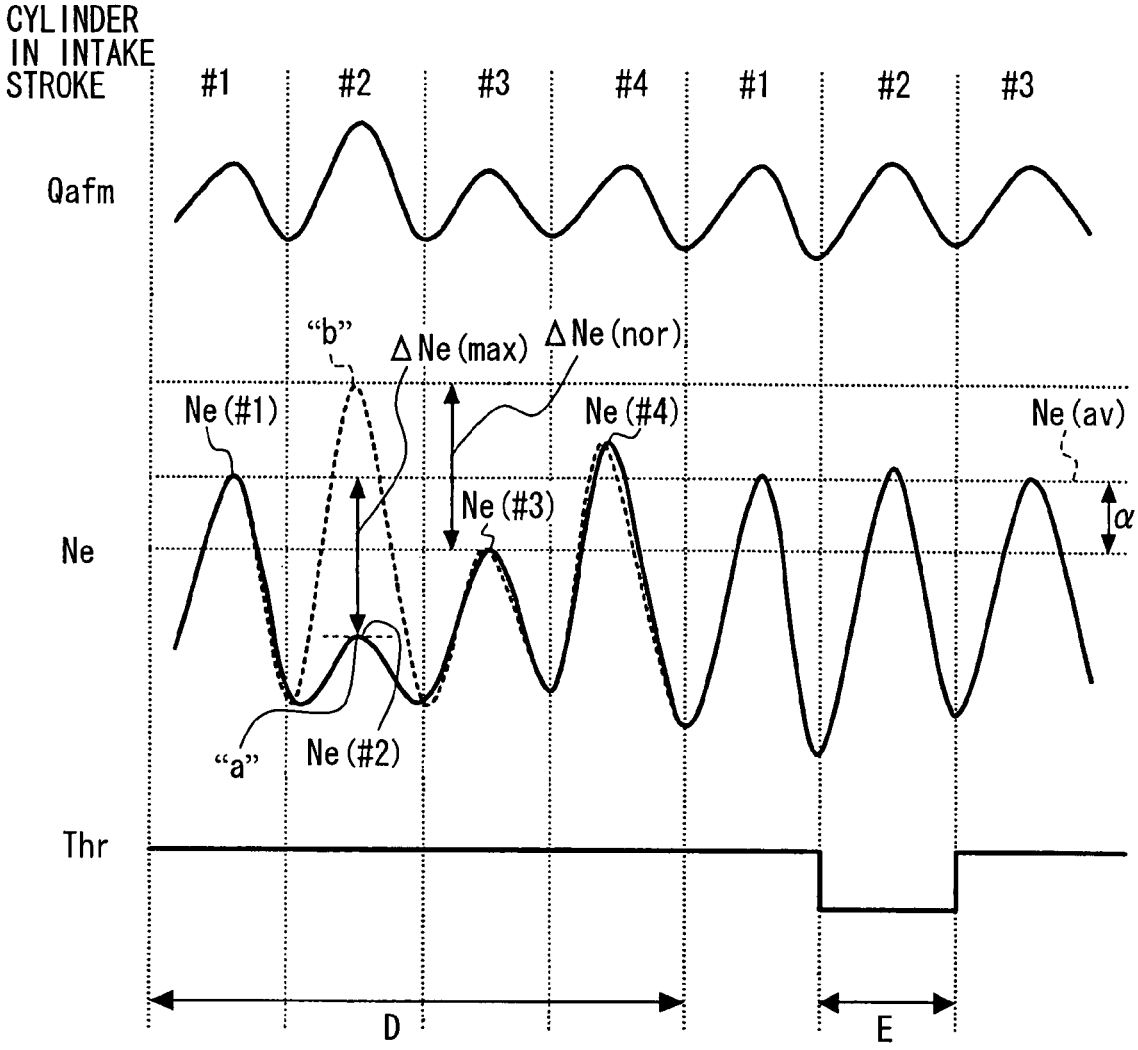
FIG. 13 is a time chart for explaining each cylinder intake throttle valve opening degree correction according to a third embodiment of the present invention.

For example, as shown in the time chart of FIG. 13, the maximum values (peak values) of the rotation speed Ne corresponding to the combustion strokes of the respective cylinders (first cylinder #1 to fourth cylinder #4) are calculated as the rotation speeds Ne(#1)-Ne(#4) of the respective cylinders #1-#4 during the EGR increase control. Then, average rotation speed Ne(av) of all the cylinders is calculated from the rotation speeds Ne(#1)-Ne(#4) of the respective cylinders. Then, deviations between the average rotation speed Ne(av) of all the cylinders and the rotation speeds Ne(#1)-Ne(#4) of the respective cylinders are calculated. Thus, rotation fluctuation amounts ΔNe(#1)-ΔNe(#4) of the respective cylinders toward the lower rotation speed from the average rotation speed Ne(av) of all the cylinders are calculated (i.e., ΔNe(#i) =Ne(av)−Ne(#i), i=1 to 4)

Then, the maximum rotation fluctuation amount ΔNe (max) is determined out of the rotation fluctuation amounts ΔNe(#1)-ΔNe(#4) of the respective cylinders in a predetermined period (period D shown in FIG. 13, for example, period of 720° CA). If the maximum rotation fluctuation amount ΔNe(max) is equal to or greater than a predetermined value α, it is determined that the cylinder corresponding to the maximum rotation fluctuation amount ΔNe(max) is the large leak air cylinder. That is, in the cylinder causing the large leak air quantity, the combustion state becomes unstable during the EGR increase control, and the rotation speed falls greatly over the normal variation range ΔNe(nor). Therefore, the cylinder causing the rotation fluctuation amount ΔNe that is directed toward the lower rotation speed from the average rotation speed Ne(av) of all the cylinders and that is equal to or greater than the predetermined value α is determined to be the large leak air cylinder.

Then, the opening degree Thr of the intake throttle valve 19 is corrected in accordance with the maximum rotation fluctuation amount ΔNe(max) reflecting the leak air quantity of the intake throttle valve 19 of the large leak air cylinder during a period (period E, in FIG. 13) corresponding to the intake stroke of the large leak air cylinder. Thus, the opening degree Thr of the intake throttle valve 19 is corrected in accordance with the leak air quantity of the intake throttle valve 19 of the large leak air cylinder.

By repeatedly performing the processing of sensing the rotation fluctuations of the respective cylinders during the EGR increase control, the processing of determining the large leak air cylinder based on the rotation fluctuations of the respective cylinders, and the processing of correcting the opening degree Thr of the intake throttle valve 19 in the period corresponding to the intake stroke of the large leak air cylinder, the variation among the intake air quantities due to the variation among the leak air quantities of the intake throttle valves 19 of the respective cylinders is corrected with high accuracy. Thus, the engine rotation fluctuation due to the variation among the leak air quantities of the intake throttle valves 19 of the respective cylinders is inhibited.

Next, the contents of processing of the each cylinder intake throttle valve opening degree correction program shown in FIG. 14 executed by the ECU 28 will be explained. The each cylinder intake throttle valve opening degree correction program shown in FIG. 14 is executed in a predetermined cycle while the ECU 28 is energized. If the program is started, S401 first determines whether the low load operation of the engine 11 is in progress. If S401 is YES, the processing proceeds to S402 to perform the EGR increase control for controlling the EGR valve 30 such that the EGR quantity increases.

Then, the processing proceeds to S403 to determine whether the EGR quantities of all the cylinders have increased, for example, based on whether a predetermined period necessary for the EGR quantities of all the cylinders to increase has elapsed. If it is determined that the EGR quantities of all the cylinders have increased, the processing proceeds to S404 to calculate the maximum values (peak values) of the rotation speed Ne corresponding to the combustion strokes of the respective cylinders as the rotation speeds Ne(#1)-Ne(#4) of the respective cylinders based on the output of the crank angle sensor 26 during the EGR increase control. Then, the processing proceeds to Step S405 to calculate the average rotation speed Ne(av) of all the cylinders from the rotation speeds Ne(#1)-Ne(#4) of the respective cylinders.

Then, the processing proceeds to S406. S406 calculates the deviations between the average rotation speed Ne(av) of all the cylinders and the rotation speeds Ne(#1)-Ne(#4) of the respective cylinders as the rotation fluctuation amounts ΔNe (#1)-ΔNe(#4) of the respective cylinders toward the lower rotation speed from the average rotation speed Ne(av) of all the cylinders (i.e., ΔNe(#i)=Ne(av)−Ne(#i), i=1 to 4).

Then, the processing proceeds to S407 to determine the maximum rotation fluctuation amount ΔNe(max) out of the rotation fluctuation amounts ΔNe(#1)-ΔNe(#4) of the respective cylinders in the predetermined period (for example, period of 720° CA). Then, the processing proceeds to S408 to determine whether the maximum rotation fluctuation amount ΔNe(max) is equal to or greater than the predetermined value α.

If S408 determines that the maximum rotation fluctuation amount ΔNe(max) is smaller than the predetermined value α, the maximum rotation fluctuation amount ΔNe(max) is within the normal variation range ΔNe(nor). Therefore, the cylinder corresponding to the maximum rotation fluctuation amount ΔNe(max) is determined not to be the large leak air cylinder, and the program is ended.

If S408 determines that the maximum rotation fluctuation amount ΔNe(max) is equal to or greater than the predetermined value α, the maximum rotation fluctuation amount ΔNe(max) exceeds the normal variation range ΔNe(nor). In this case, the processing proceeds to S409 to determine that the cylinder corresponding to the maximum rotation fluctuation amount ΔNe(max) is the large leak air cylinder. Then, the processing proceeds to S410 to correct the opening degree of the intake throttle valve 19 in the period corresponding to the intake stroke of the large leak air cylinder in accordance with the maximum rotation fluctuation amount ΔNe(max) reflecting the leak air quantity of the intake throttle valve 19 of the large leak air cylinder. Thus, the opening degree of the intake throttle valve 19 is corrected in accordance with the leak air quantity of the intake throttle valve 19 of the large leak air cylinder. In this case, the opening degree of the intake throttle valve 19 is corrected such that the variation among the intake air quantities due to the variation among the leak air quantities is corrected.

By repeatedly executing the program, the variation among the intake air quantities due to the variation among the leak air quantities of the intake throttle valves 19 of the respective cylinders is corrected with high accuracy. As a result, the engine rotation fluctuation due to the variation among the leak air quantities of the intake throttle valves 19 of the respective cylinders is inhibited.

In the above-described third embodiment, attention is paid to the phenomenon that, if the EGR quantity is increased during the low load operation of the engine 11, the combustion state in the cylinder causing the large leak air quantity of the intake throttle valve 19 becomes unstable due to the influence of the EGR and the rotation speed corresponding to the combustion stroke of the cylinder falls greatly. In the third embodiment, the rotation fluctuation amounts ΔNe(#1)-ΔNe (#4) of the respective cylinders toward the lower rotation speed from the average rotation speed Ne(av) of all the cylinders are calculated during the EGR increase control for increasing the EGR quantity during the low load operation of the engine. The cylinder corresponding to the maximum rotation fluctuation amount ΔNe(max) is determined to be the large leak air cylinder. The opening degree of the intake throttle valve 19 is corrected in accordance with the maximum rotation fluctuation amount ΔNe(max) reflecting the leak air quantity of the intake throttle valve 19 of the large leak air cylinder during the period corresponding to the intake stroke of the large leak air cylinder. Thus, the opening degree of the intake throttle valve 19 is corrected in accordance with the leak air quantity of the intake throttle valve 19 of the large leak air cylinder.

By repeatedly executing these processings, the variation among the intake air quantities due to the variation among the leak air quantities of the intake throttle valves 19 of the respective cylinders can be corrected with high accuracy. Thus, the engine rotation fluctuation due to the variation among the leak air quantities of the intake throttle valves 19 of the respective cylinders can be inhibited, and the stability of the idle speed can be improved during the idle operation.

Moreover, there is no need to provide the bypass passages bypassing the intake throttle valves 19 of the respective cylinders or the control valves that open and close the bypass passages. Therefore, the system structure can be simplified and the cost can be reduced. The present invention may be applied to the system having the bypass passages bypassing the intake throttle valves 19 in the intake manifolds 14 of the respective cylinders and the control valves in the bypass passages of the respective cylinders for opening/closing the bypass passages respectively.

The maximum rotation fluctuation amount ΔNe(max) exceeds the normal variation range ΔNe(nor) when the maximum rotation fluctuation amount ΔNe(max) is greater than the predetermined value α. Therefore, in the present embodiment, it is determined that the cylinder corresponding to the maximum rotation fluctuation amount ΔNe(max) is the large leak air cylinder. When the maximum rotation fluctuation amount ΔNe(max) is smaller than the predetermined value α, the maximum rotation fluctuation amount ΔNe(max) is within the normal variation range ΔNe(nor). In this case, it is determined that the cylinder corresponding to the maximum rotation fluctuation amount ΔNe(max) is not the large leak air cylinder. Thus, erroneous determination that the cylinder causing the rotation speed slightly lower than the average rotation speed is the large leak air cylinder can be precluded.

In the third embodiment, it is determined that the cylinder causing the largest rotation fluctuation amount toward the lower rotation speed from the average rotation speed of all the cylinders during the EGR increase control is the large leak air cylinder. Alternatively, it may be determined that the cylinder causing the largest rotation fluctuation amount between the time before the EGR increase control is performed and the time when the EGR increase control is performed is the large leak air cylinder.

In the third embodiment, the EGR increase control for increasing the external EGR quantity by controlling the EGR valve 30 is performed. In a system having a variable valve timing device that changes valve timing of the intake valve or the exhaust valve, the EGR increase control for increasing an internal EGR quantity by controlling a valve overlap amount between the intake valve and the exhaust valve may be performed.

In the first to third embodiments, the present invention is applied to the four-cylinder engine. Alternatively, the present invention may be applied to a two-cylinder engine, a three-cylinder engine, or an engine having five or more cylinders.

In the first to third embodiments, the present invention is applied to the intake port injection engine. Alternatively, the present invention may be applied to a direct injection engine or a dual injection engine having injectors in both of the intake port and the cylinder.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A controller of an internal combustion engine having intake throttle valves in branch intake passages of respective cylinders for regulating intake air quantities, the branch intake passages branching from a main intake passage of the engine for introducing the intake air into the respective cylinders, the controller comprising:

an intake air quantity sensor provided in the main intake passage for sensing the intake air quantity;

a low opening degree control device that performs low opening degree control for controlling an opening degree of the intake throttle valve during a first intake stroke period since an engine start is commenced until first intake strokes of the respective cylinders end such that intake pressure downstream of the intake throttle valve becomes pressure equal to or lower than predetermined critical pressure with respect to intake pressure upstream of the intake throttle valve during the intake stroke of each cylinder;

a leak air quantity calculation device that calculates a leak air quantity at the time when the intake throttle valve is fully closed based on the intake air quantity sensed with the intake air quantity sensor during the low opening degree control; and an intake throttle valve opening degree correction device that corrects the opening degree of the intake throttle valve in accordance with the leak air quantity.

2. The controller as in claim 1, further comprising:

an idle speed control device that performs idle speed control for performing feedback control of the opening degree of the intake throttle valve such that actual rotation speed of the engine coincides with target idle speed during idle operation of the engine, wherein the intake throttle valve opening degree correction device corrects a feedback gain of the idle speed control in accordance with the leak air quantity during the idle speed control.

* * * * *